US008376357B2

(12) United States Patent
Tharayil et al.

(10) Patent No.: US 8,376,357 B2
(45) Date of Patent: Feb. 19, 2013

(54) SHEET REGISTRATION USING INPUT-STATE LINEARIZATION IN A MEDIA HANDLING ASSEMBLY

(75) Inventors: Marina L. Tharayil, Rochester, NY (US); Silvia Mastellone, Gebenstorf (CH); Jack Gaynor Elliot, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 520 days.

(21) Appl. No.: 12/688,419

(22) Filed: Jan. 15, 2010

(65) Prior Publication Data

US 2011/0175280 A1 Jul. 21, 2011

(51) Int. Cl.
*B65H 7/02* (2006.01)

(52) U.S. Cl. ..... 271/228

(58) Field of Classification Search ..... 271/226, 271/227, 228

See application file for complete search history.

(56) References Cited

U.S. PATENT DOCUMENTS

| | | | | |
|---|---|---|---|---|
| 6,055,063 | A | 4/2000 | Yang et al. | |
| 7,593,684 | B2 * | 9/2009 | De Jong et al. | 399/395 |
| 7,717,533 | B2 * | 5/2010 | De Jong et al. | 347/16 |
| 2008/0012214 | A1 * | 1/2008 | Elliot | 271/227 |
| 2008/0012215 | A1 * | 1/2008 | Elliot | 271/228 |
| 2008/0136092 | A1 * | 6/2008 | Elliot | 271/228 |
| 2008/0136094 | A1 * | 6/2008 | Elliot | 271/270 |
| 2008/0237975 | A1 * | 10/2008 | de Jong et al. | 271/228 |
| 2008/0306626 | A1 * | 12/2008 | Elliot | 700/230 |

OTHER PUBLICATIONS

Richard C. Dorf, et al., "Modern Control Systems", Ch. 11, pp. 641-675 and 687, 1998, Addison Wesley Longman, Inc., 1998.

Stipanovic, et al., "Decentralized overlapping control of a formation of unmanned aerial vehicles", Automatica 40 (2004), pp. 1285-1296, Elsevier, Feb. 2004.

Jack G. Elliot, et al., "Closed-Loop Control of an Underactuated Sheet Registration Device Using Feedback Linearization and Gain Scheduling", IEEE Transactions on Control Systems Technology, vol. 16, No. 4, Jul. 2008.

* cited by examiner

*Primary Examiner* — Jeremy R Severson

(74) *Attorney, Agent, or Firm* — Hoffmann & Baron, LLP

(57) ABSTRACT

Registering a sheet in a differential drive registration system by identifying observed state values corresponding to a sheet handled by the differential drive registration system. The method also including determining an error vector, wherein the error vector is defined by a difference between the observed state values and reference state values for the sheet. Control input values are also determined based on the error vector, a set of control parameters, and the observed state values. The control input values being determined such that there is a linear differential relationship between the observed state values and the control input values. Additionally the method includes generating drive wheel velocities in the differential drive registration system based on the control input values. The identifying and determining steps being repeated for the sheet in a closed-loop process such that the observed state values substantially track the reference state values.

18 Claims, 3 Drawing Sheets

SHEET REGISTRATION USING INPUT-STATE LINEARIZATION IN A MEDIA HANDLING ASSEMBLY

INCORPORATION BY REFERENCE

The following US patent applications are incorporated in their entirety for the teachings therein: U.S. patent Ser. No. 11/457,944, filed Jul. 17, 2006, entitled "Feed-back based Document Handling Control System;" and U.S. patent Ser. No. 11/457,892, filed Jul. 17, 2006, entitled "Feed-back based Document Handling Control System," both commonly assigned to the assignee hereof.

TECHNICAL FIELD

The presently disclosed technologies are directed to systems and methods used to improving the registration of sheets in a media handling assembly, such as a printing system. The systems and methods described herein use input-state feedback linearization in order to correct errors in sheet position, orientation and/or speed before it is delivered to a desired registration datum.

BACKGROUND

In media handling assemblies, particularly in printing systems, accurate and reliable registration of the substrate media as it is transferred in a process direction is desirable. In particular, accurate registration of the substrate media, such as a sheet of paper, as it is delivered at a target time to an image transfer zone will improve the overall printing process. The substrate media is generally conveyed within the system in a process direction. However, often the substrate media can shift in a cross-process direction that is lateral to the process direction or even acquire and angular orientation, referred herein as "skew," such that its opposed linear edges are no longer parallel to the process direction. Thus, there are three degrees of freedom in which the substrate media can move, which need to be controlled in order to achieve accurate delivery thereof. A slight skew, lateral misalignment or error in the arrival time of the substrate media through a critical processing phase can lead to errors, such as image and/or color registration errors relating to arrival at an image transfer zone. Also, as the substrate media is transferred between sections of the media handling assembly, the amount of registration error can increase or accumulate. A substantial skew and/or registration error can cause pushing, pulling or shearing forces to be generated, which can wrinkle, buckle or even tear the sheet.

Contemporary systems transport a sheet and deliver it at a target time to a "datum," based on positional measurements from the sheet. That datum, also referred to herein as a delivery registration datum, can be a particular point in a transfer zone, a hand-off point to a downstream nip assembly or any other target location within the media handling assembly. Typically, the time and orientation of the sheet arriving in a sheet registration system is measured by sensors located near the input of the registration system. A controller, in the form of an automated processing device, then computes a sheet velocity command profile designed to deliver the sheet at a target time that delivery registration datum. A sheet velocity actuator commanded by the controller then executes a command profile in order to timely and accurately deliver the sheet. Examples of typical sheet registration and deskewing systems are disclosed in U.S. Pat. Nos. 5,094,442, 6,533,268, 6,575,458 and 7,422,211, commonly assigned to the assignee of record herein, namely Xerox Corporation, the disclosures of which are each incorporated herein by reference. While these systems particularly relate to printing systems, similar paper handling techniques apply to other media handling assemblies.

Such contemporary systems attempt to achieve position registration of sheets by separately varying the speeds of laterally spaced apart drive wheels in registration nip assemblies to correct for skew mispositioning of the sheet, which is also referred to as differentially driven drive or nip assemblies. As these assemblies are used to register sheets in media handling assemblies, they are also referred to as differential drive registration systems, such as that disclosed in U.S. Pat. No. 7,422,211. Separate drive motors and/or belt assemblies are often included in differential drive registration systems, for imparting an angular velocity to the driven wheels. While each motor may be connected directly to the driven wheels, belts (also referred to as timing belts) are often employed. Also, the motors may be stepper motors or DC servo motors with encoder feedback from an encoder mounted on the motor shaft, a driven wheel shaft or the idler shaft. Such registration nip assemblies also generally includes sheet sensors, which are used to detect the arrival of a sheet, its lateral position, skew and other characteristics. Temporarily driving the laterally spaced nips at slightly different rotational speeds will produce a slight difference in the total rotation or relative pitch position of each drive roll while the sheet is held in the two nips. In this way, one side of the sheet moves ahead of the other to induce a change in skew (small partial rotation) in the sheet, opposite from an initially detected sheet skew in order to eliminate and correct for the detected skew.

Sheet registration systems typically use sensors to detect a location of a sheet at various points during its transport. Sensors are often used to detect a leading edge of the sheet and/or a side of the sheet to determine the orientation of the sheet as it passes over the sensors. Based on the information retrieved from the sensors, the angular velocity of one or more nips can be modified to correct the alignment of the sheet.

FIGS. 4 and 5 illustrate a basic contemporary sheet registration system. A nip 105, 110 is formed by the squeezing together of two rolls, typically an drive roll 102 and idler roll 104, thereby creating a rotating device used to propel a sheet 125 in a process direction P by its passing between the rolls. An active nip is a nip rotated by a motor 115, 120 that can cause the nip to rotate at a variable nip velocity. Typically, a sheet registration system includes at least two active nips having separate motors. As such, by altering the angular velocities $\omega_1$, $\omega_2$ at which the two active nips are rotated, the sheet registration system may deliver the sheet 125 to the registration datum D in a registered state. A registered state meaning the sheet is delivered at a desired time with a desired positioning, orientation and rate of movement (i.e., properly register the a sheet).

Numerous sheet registration systems have been developed. For example, the sheet registration system described in U.S. Pat. No. 4,971,304 to Lofthus, which is incorporated herein by reference in its entirety, describes a system incorporating an array of sensors and two active nips. The active sheet registration system provides deskewing and registration of sheets along a process path P having an X, Y and θ coordinate system. Sheet drivers are independently controllable to selectively provide differential and non-differential driving of the sheet in accordance with the position of the sheet as sensed by the array of sensors. The sheet is driven non-differentially until the initial random skew is measured. The sheet is then driven differentially to correct the measured skew and to induce a known skew. The sheet is then driven non-differentially until a side edge is detected, whereupon the sheet is driven differentially to compensate for the known skew. Upon final deskewing, the sheet is driven non-differentially outwardly from the deskewing and registration arrangement.

A second sheet registration system is described in U.S. Pat. No. 5,678,159 to Williams et al., which is incorporated herein by reference in its entirety. U.S. Pat. No. 5,678,159 describes a deskewing and registering device for an electrophotographic printing machine. A single set of sensors determines the position and skew of a sheet in a paper process path and generates signals indicative thereof. A pair of independently driven nips forwards the sheet to a registration position in skew and at the proper time based on signals from a registration controller which interprets the position signals and generates the motor control signals. An additional set of sensors can be used at the registration position to provide feedback for updating the control signals as rolls wear or different substrates having different coefficients of friction are used.

In addition, U.S. Pat. No. 5,887,996 to Castelli et al., which is incorporated herein by reference in its entirety, describes an electrophotographic printing machine having a device for registering and deskewing a sheet along a paper process path including a single sensor located along an edge of the paper process path. The sensor is used to sense a position of a sheet in the paper path and to generate a signal indicative thereof. A pair of independently driven nips is located in the paper path for forwarding a sheet there along. A registration controller receives signals from the sensor and generates motor control drive signals for the pair of independently driven nips. The drive signals are used to deskew and register a sheet at a registration position in the paper path.

FIGS. 4 and 5 depict an exemplary sheet registration device according to the known art. The sheet registration device 100 includes two nips 105, 110 which are independently driven by corresponding motors 115, 120 for moving a sheet 125 being handled by the device 100. The motors 115, 120 are typically actuated by one or more controllers 150, which can be located almost anywhere in the system outside of the sheet path. The resulting 2-actuator device embodies a simple registration device that enables sheet registration having three degrees of freedom. The under-actuated (i.e., fewer actuators than degrees of freedom) nature makes the registration device 100 a nonholonomic and nonlinear system that cannot be controlled directly with conventional linear techniques. The control for such systems often employs open-loop (feed-forward) motion planning.

In an open-loop motion planning control process one or more sensors, such as $P_1$, $P_2$, $E_1$ and $E_2$ shown in FIG. 5, are used to determine an input position of the sheet 125 when the lead edge of the sheet is first detected by $P_2$. An open-loop motion planner device interprets the information retrieved from the sensors as the input position and calculates a set of desired velocity profiles that will steer the sheet along a viable path to the final registered position if perfectly tracked (i.e., assuming that no slippage or other errors occur). One or more motor controllers 150 are used to control the desired velocities. The one or more motor controllers 150 generate motor voltages for the motors 115, 120. The motor voltages determine the angular velocities $\omega_1$, $\omega_2$ at which each corresponding nip 105, 110 is rotated. The sheet velocities $v_1$, $v_2$ at each nip 105, 110 are computed as the radius c of the drive roll 102 multiplied by the angular velocity of the roll ($\omega_1$ for 105 and $\omega_2$ for 110). The angular velocities $\omega_1$, $\omega_2$ of the nips 105, 110 transfer to the sheet in order to achieve accurate registration.

In an open-loop system, although the sheet is not monitored for path conformance during the process, an additional set of sensors, such as $P_3$, $E_3$ and $E_2$ in FIG. 5, can be placed at the end of the registration system 100 to provide a snapshot of the output for adapting the motion planning algorithm. However, because path conformance is not monitored, error conditions that occur in an open-loop system may result in errors at the output that require multiple sheets to correct. In addition, although open-loop motion planning can be used to remove static (or "DC") sources of errors, the open-loop nature of the underlying motion planning remains vulnerable to changing (or "AC") sources of error. Accordingly, the sheet registration system may improperly register the sheet due to slippage or other errors in the system.

Accordingly, it would be desirable to provide a method and apparatus capable of more accurately registering a sheet in a media handling assembly, which overcomes the shortcoming of the prior art.

SUMMARY

According to aspects described herein, there is disclosed a method of registering sheets moved along a transport path in a differential drive registration system of a media handling assembly. The method including identifying observed state values corresponding to a sheet handled by the differential drive registration system. The method also including determining an error vector, wherein the error vector is defined by a difference between the observed state values and reference state values for the sheet. Control input values are also determined based on the error vector, a set of control parameters, and the observed state values. The control input values being determined such that there is a linear differential relationship between the observed state values and the control input values. Additionally the method includes generating drive wheel velocities in the differential drive registration system based on the control input values. The identifying and determining steps being repeated for the sheet in a closed-loop process such that the observed state values substantially track the reference state values.

According to other aspects described herein the control input values can be determined such that derivatives with respect to time of transformed observed state values are a linear function of the transformed observed state values and transformed control input values. Also, the error vector can be determined at least partially by converting observed state values into linearized state values. Further, at least one set of observed sheet state values can be measured directly by a sensor. The control input values can also be determined by a stabilizing linear controller that stabilizes the error vector. The observed state values can include at least one of the speed, position and orientation of the sheet relative to the differential drive registration system. Additionally, the determination of the error vector can be based on a linearized sheet trajectory that corresponds to the reference state values. Further, the control input values can include a linear acceleration and an angular velocity. The control input values can also define a linear time invariant system. Further still, the determination of the error vector can be based at least in part on a non-linear transformation to basic equations of motion for the sheet, thereby introducing a change of state variable, wherein the change of state variable represents the sheet speed and is not zero.

According to other aspects described herein, there is disclosed a further method of registering sheets moved along a transport path in a differential drive registration system of a media handling assembly. The method includes determining an error vector for a sheet and generating control input values based on the error vector. The error vector is defined by a difference between observed state values and reference state values. The control input values further based on a set of control parameters and the observed state values. The control input values being determined such that there is a linear differential relationship between the observed state values and the control input values. In this way, by using a closed-loop feedback control system the control input values determine drive wheel velocities in the differential drive registration system that substantially drive the sheet to a registered sheet state.

Additionally, as part of the further method the control input values can be determined such that derivatives with respect to time of transformed observed state values are a linear function of the transformed observed state values and transformed control input values. Also, wherein the error vector is determined at least partially by converting observed state values into linearized state values. At least one set of observed sheet state values can be measured directly by a sensor. Further, the sheet input control values can be generated by a stabilizing linear controller that stabilizes the error vector. Each set of sheet state values can include at least one of the speed, position and orientation of the sheet relative to the differential drive registration system. Also, the determined drive wheel velocities can be generated by changing a voltage to at least one motor that operates a drive wheel directly engaging the sheet. Further still, the control input values can include a linear acceleration and an angular velocity for the drive wheels. The control input values can define a linear time invariant system. Yet further still, the determination of the error vector can be based, at least in part, on a non-linear transformation to basic equations of motion for the sheet.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
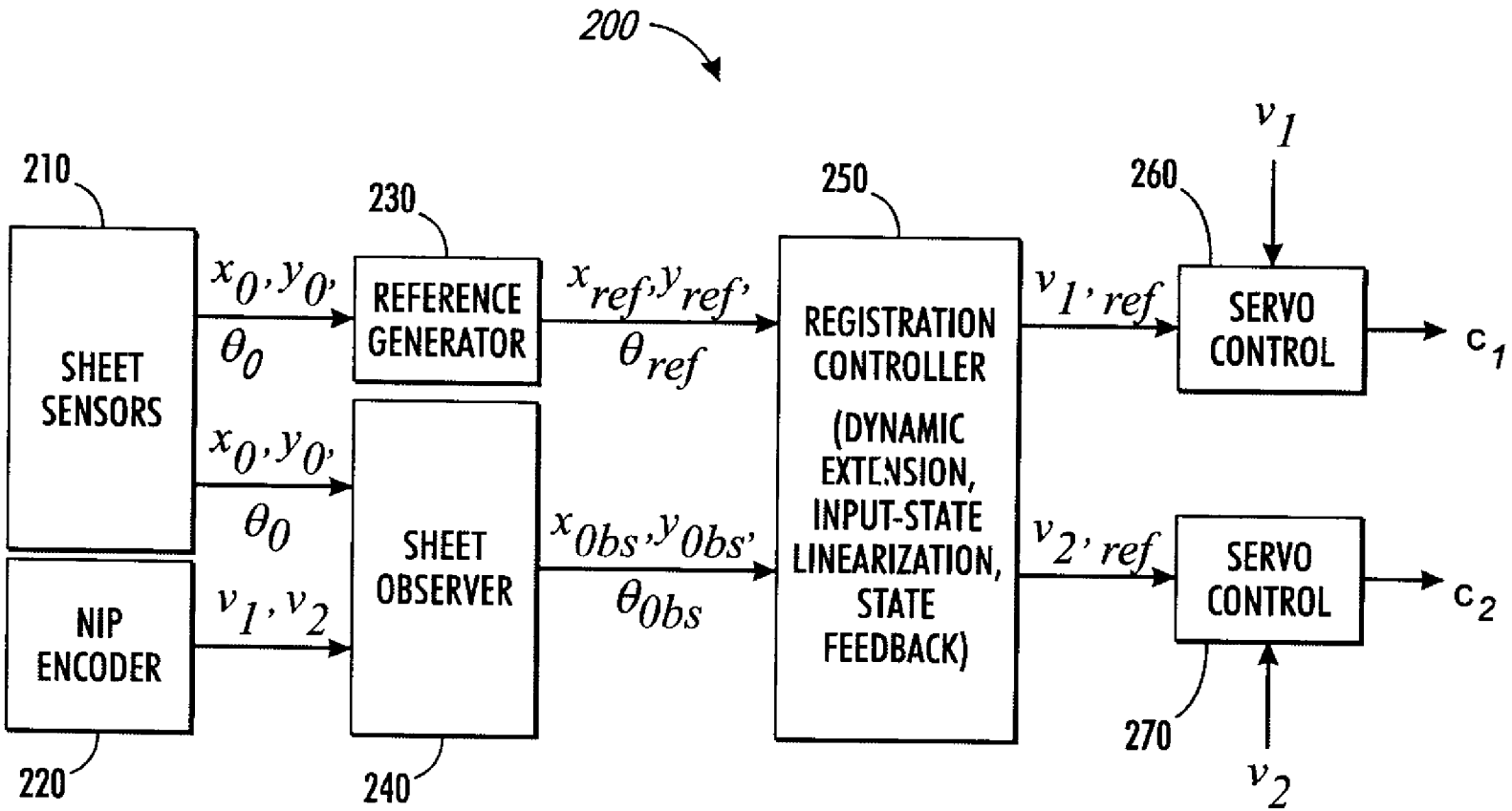
FIG. 1 shows an exemplary closed-loop sheet registration system for registering a sheet in a media handling assembly in accordance with an aspect of the disclosed technologies.

Describing now in further detail these exemplary embodiments with reference to the Figures, as described above the accurate sheet leading edge registration system and method are typically used in a select location or locations of the paper path or paths of various conventional media handling assemblies. Thus, only a portion of an exemplary media handling assembly path is illustrated herein.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction.

As used herein, a "media handling assembly" refers to one or more devices used for handling and/or transporting substrate media, including feeding, printing, finishing, registration and transport systems.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, a "nip," "nips," a "nip assembly" or "nip assemblies" refers to an assembly of elements that include at least two adjacent wheels and supporting structure, where the two adjacent wheels are adapted to matingly engage opposed sides of a substrate media. One of the two wheels can include a driven wheel, while at least one of the two wheels is a freely rotating idler wheel. Together the two wheels guide or convey the substrate media within a media handling assembly. More than two sets of mating wheels can be provided in a laterally spaced configuration to form a nip assembly. It should be further understood that such wheels are also referred to interchangeably herein as rolls.

As used herein, "skew" refers to a physical orientation of a substrate media relative to a process direction. In particular, skew refers to a misalignment, slant or oblique orientation of an edge of the substrate media relative to a process direction.

As used herein, the terms "process" and "process direction" refer to a process of moving, transporting and/or handling a substrate media. The process direction substantially coincides with a direction of a flow path P along which the substrate media is primarily moved within the media handling assembly. Such a flow path P is said to flow from upstream to downstream. A "lateral direction" or "cross-process direction" are used interchangeably herein and both refer to at least one of two directions that generally extend sideways relative to the process direction. From the reference of a sheet handled in the process path, an axis extending through the two opposed side edges of the sheet and extending perpendicular to the process direction is considered to extend along a lateral or cross-process direction. With reference to the orientation of the drawings in FIGS. 1-5 and 7, a lateral direction is either up or down.

As used herein, a "printer," "printing assembly" or "printing system" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like.

Also, such a printing system can print and/or handle either monochrome or color image data.

Figure 2:
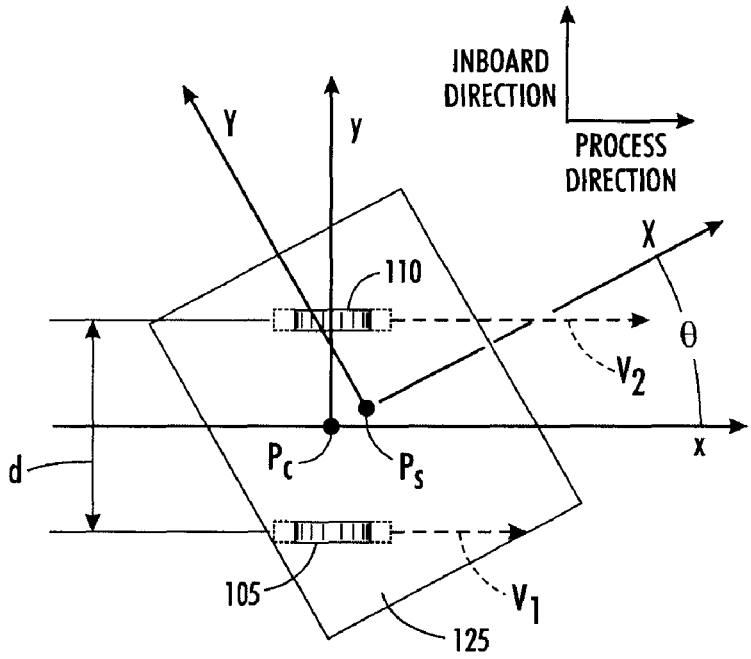
FIG. 2 depicts and exemplary reference frame in a sheet registration system using the drive nips as a base of reference in accordance with an aspect of the disclosed technologies.
Figure 3:
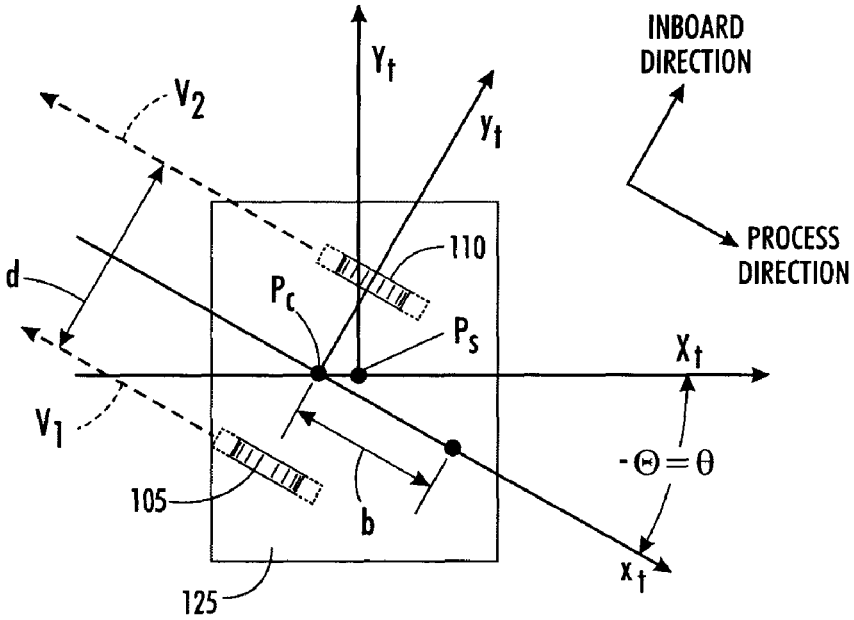
FIG. 3 depicts and exemplary reference frame in a sheet registration system using the sheet as a base of reference in accordance with an aspect of the disclosed technologies.
Figure 4:
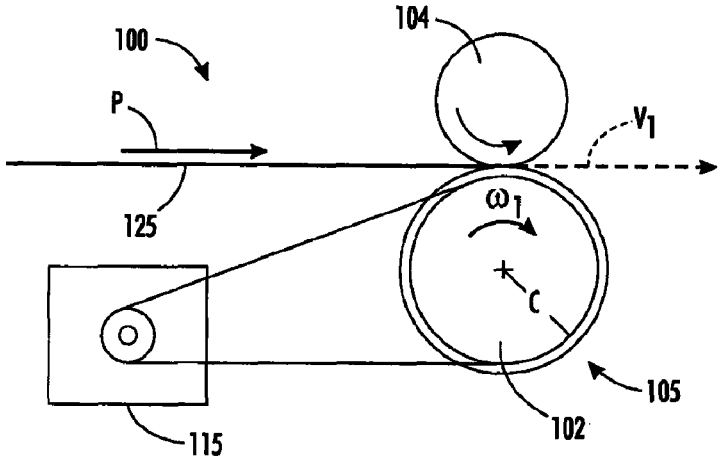
FIG. 4 PRIOR ART
FIG. 4 is a schematic elevation view of an exemplary sheet registration nip assembly in accordance with known art.
Figure 5:
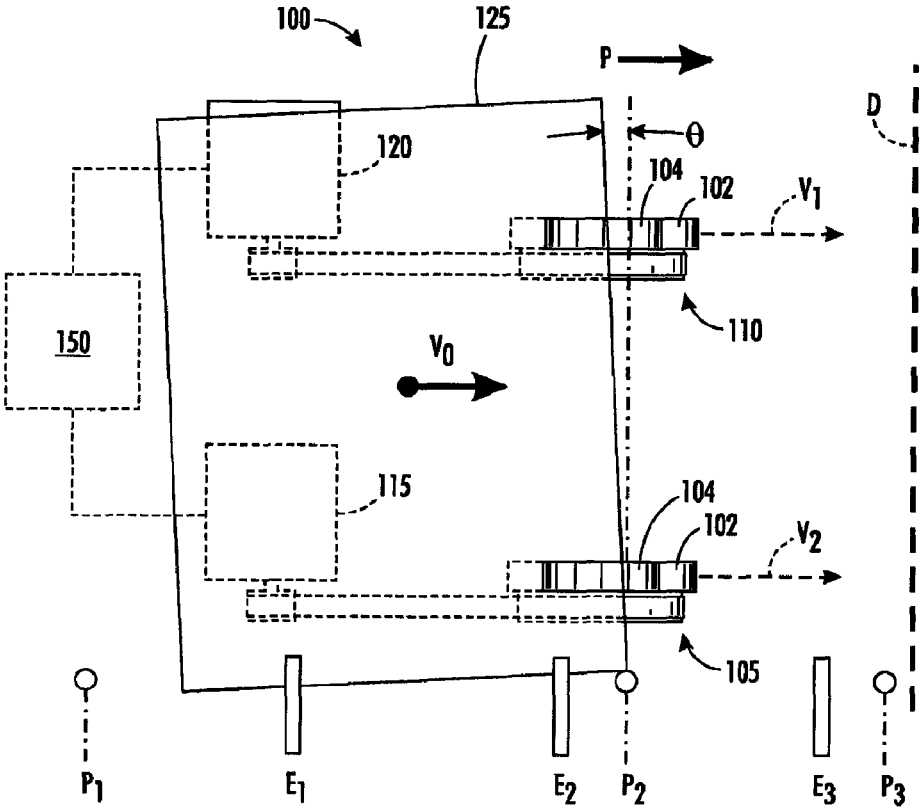
FIG. 5 PRIOR ART
FIG. 5 is a schematic plan view of an exemplary sheet registration system in accordance with known art.

A closed-loop feedback control process may have numerous advantages over open-loop control processes, such as the one described above. For example, the closed-loop control process may improve accuracy and robustness. FIGS. 2 and 3 show inboard and outboard nips 105, 110 that act as the two actuators for a sheet registration system. However, errors between desired and actual sheet velocities may occur. Error may be caused by, for example, a discrepancy between the actual sheet velocity and an assumed sheet velocity. Current systems assume that the rotational motion of parts within the device, specifically the drive rolls that contact and impart motion on a sheet being registered, exactly determine the sheet motion. Manufacturing tolerances, nip strain and slip may create errors in the assumed linear relationship between roller rotation and sheet velocity. Also, finite servo bandwidth may lead to other errors. Even if the sheet velocity is perfectly and precisely measured, tracking error may exist in the presence of noise and disturbances. Error may also result as the desired velocity changes for a sheet.

The proposed closed-loop controller architecture algorithm may take advantage of position feedback during every sample period to increase the accuracy and robustness of registration. Open-loop motion planning cannot take advantage of position feedback. As such, the open-loop approach may be subject to inescapable sheet velocity errors that lead directly to registration error. In contrast, a closed-loop process as described herein uses feedback to ensure that the sheet movement automatically adjusts in real-time based on the actual (observed) sheet position and/or speed measured during registration. A closed-loop process uses measurements of a system and compares it to desired values for that system. In this way, the process repeatedly measures characteristics of each sheet as it is handled by the registration system so that if it deviates from desired values, the registration system acts to bring it back to those desired values. As such, the closed-loop process may be less sensitive to velocity error and servo bandwidth and may be more robust as a result.

In addition, current open-loop algorithms may rely on teaming based on performance assessment to satisfy performance specifications. Additional sensors may be required to perform the learning process increasing the cost of the registration system. When a novel sheet is introduced, such as, for example, during initialization of a printing machine, when feed trays are changed, and/or when switching between two sheet types, "out of specification" performance may occur for a plurality of sheets while the algorithm converges. In some systems, the out of specification performance may exist for 20 sheets or more.

FIG. 1 depicts an exemplary closed-loop feedback motion planning control process according to an aspect of the disclosed technologies. The closed-loop control process 200 receives and interprets the information retrieved from a sheet registration system 100 to accurately register a sheet. Information from sheet sensors 210 are input to a reference generator 230. The reference generator 230 calculates a reference trajectory that will adjust the sheet speed, position and orientation so that it is delivered to the datum D in an allocated amount of time $t_{reg}$. Also, information from the sheet sensors 210 and nip encoders 220 is input to a sheet observer 240 that calculates sheet positions during registration. Thus, using input from both the reference generator 230 and the sheet observer 240, a registration controller 250 uses algorithmic methods to calculate control inputs that will drive servo-controls 260, 270 to generate drive wheel velocities necessary to properly register the sheet and substantially eliminate any error in its position, orientation and speed, as well as timely delivered it to the registration datum D.

The sheet sensors 210 can include point sensors $P_1$, $P_2$, $P_3$ and edge sensors $E_1$, $E_2$, $E_3$. The sheet sensors 210 are used to determine a position and orientation of the sheet 125. In particular, the sheet sensors 210 are used to detect and/or measure the process and cross-process position, as well as the skew orientation of the sheet 125.

The nip encoders 220 can include one or more idler encoders that are used to detect actual sheet velocities $v_1$, $v_2$ during the registration process. Idler encoders (not shown), are a common form of nip encoder that is mounted on the rotational shaft of the idler roll 104 (shown in FIG. 4), and provides a measurement of the angular turn rate of the idler roll 104. The idler roll angular turn rate is commonly associated with a localized measurement of the sheet speed $v_1$, $v_2$ in the small regions where the idler rolls 104 make contact with the sheet 125. It should be understood that sheet registration systems 100 can have more or fewer sensors that are placed in a variety of locations, and still used within the scope of the present disclosure, which is not limited to use with the system shown in FIGS. 4 and 5.

To implement the methods in accordance with aspects of the disclosed technologies, a reference frame from which measurements are based must be selected. The reference frames shown in FIGS. 2 and 3 (i.e., a perspective from which a system is observed) represent two basic frames of reference that can be used to analyze the operation of the sheet registration system. While an alternative reference frame could be used as desired, the two basic frames of reference shown in FIGS. 2 and 3 are used herein for illustrative purposes. Within any frame of reference, coordinates (x, y, θ) are measured from a center (also referred to herein as an "origin"). FIGS. 2 and 3 use either the center of the drive rolls (nips) $P_C$ or the center of mass of the sheet $P_S$, respectively, as their coordinate origins. For example, the reference frame in FIG. 2 is selected based upon the orientation of the drive rolls (nips), where the process direction is defined to be the x-axis, and the cross-process direction is defined to be the y-axis (perpendicular to the x-axis—in, for example, an inboard direction). A center point $P_C$ is used as the origin for purposes of reference coordinates. With such a base of reference, x represents the process direction position of the center of mass of the sheet 125 from the origin $P_C$. Similarly, y represents the cross-process direction position of the sheet 125 from the origin $P_C$. The angle θ represents the skew variable that defines the orientation of the sheet relative to the rotational axis of the nips 105, 110. In contrast, the reference frame in FIG. 3 uses the center of mass of the sheet 125 as its origin $P_S$. Also, in FIG. 3, the coordinate axis x, y run parallel to adjacent sheet edges.

An initially measured position of the sheet 125 when it enters the registration nips 105, 110 is denoted by $x_0$, $y_0$, $\theta_0$. The initially measured angular velocities $\omega_1$ and $\omega_2$ from the nip encoders can be translated into linear velocities $v_1$, $v_2$ of the sheet as it enters the registration nips. Those velocities $v_1$, $v_2$ can be averaged to provide an initial sheet velocity $v_0$. Similarly, $v_d$, $x_d$, $y_d$ and $\theta_d$ will denote a desired velocity, coordinates and orientation of the sheet at the end of registration (upon reaching the registration datum). Also, consider that registration should be complete within an assigned time $t_{reg}$, and it is generally desirable to complete any sheet registration adjustments prior to arriving at the registration datum. In order to travel from such an initial measurement point to a desired registration point, the sheet must traverse a reference trajectory. Such a reference trajectory would follow as such:

$$x_{ref}=\alpha t^2+\beta t+\gamma \quad (1a);$$

$$y_{ref}=y_d \quad (1b);$$

$$\theta_{ref}=0 \quad (1c).$$

where $x_{reg}$ is the desired sheet position in the process direction at time t. Also, t represents the time during registration ($0<t\leqq t_{reg}$) and $\alpha$, $\beta$, $\gamma$ represent the acceleration, velocity and additional distance needed to traverse the reference trajectory in the x direction. Also, $y_{reg}$ is the desired sheet position in the cross-process direction. Further, it is desirable to eliminate sheet skew, such that the final skew angle $\theta_{reg}$ should equal zero.

Now, using the reference frame of FIG. 2, equations of motion that represent the sheet kinematics can be established for the sheet being handled with reference to the differential drive registration system. The sheet kinematics mathematically represent the motion of the sheet without reference to the forces acting on the sheet. The point $P_C$, which is considered the center of the differential drive system, is used as an origin for the equations of motion which are represented as follows:

$$\dot{x}=\frac{c((d-y)\omega_1+(d+y)\omega_2)}{2d}; \quad (2a)$$

$$\dot{y}=\frac{cx(\omega_1-\omega_2)}{2d}; \quad (2b)$$

$$\dot{\theta}=\frac{c(\omega_1-\omega_2)}{2d}; \quad (2c)$$

where $\dot{x}$, $\dot{y}$, and $\dot{\theta}$ represent the process, cross-process and skew angular velocities respectively; where d is the distance between the nips 105, 110; $\omega_1$ and $\omega_2$ are the angular velocities of the nips; c is the radius of the nip drive wheels; x, y are the coordinate distances from the origin to the sheet center of mass $P_S$. The angular nip velocities $\omega_1$ and $\omega_2$ are referred to herein as input variables and are thus control inputs since the nips impart (translate) their angular velocities to a linear velocity of the sheet handled therein.

The above equations of motion (2a-2c) represent an underactuated model of sheet motion, since the number of state variables (n=3, namely x y $\theta$) is greater than the number of input variables (n=2) used to control them. A state variable being one of a minimum set of numbers which contain enough information about a sheet's movement to enable computation of the sheet's future behavior. A sheet state value represents the value of one of those numbers, defining a characteristic of the state of a sheet at a particular point in time. The state of a sheet is defined by a combination of circumstances and attributes belonging for a time to the sheet. For example, attributes such as coordinate position (x, y) coordinate orientation ($\theta$), or the movement of the sheet such as linear or angular velocity or acceleration. Consider that the process direction variable x and skew variable $\theta$ can be directly steered using the drive wheel inputs $\omega_1$, $\omega_2$, while the lateral direction y can only be indirectly affected using a combination of motions in the other two directions (x and $\theta$). Such is considered a nonholonomic system, however for paper registration, speed and time requirements must additionally be fulfilled, making the problem more challenging.

Now the objective of a controller for a differential drive registration system is to generate drive nip velocities $v_1$, $v_2$ (through corresponding angular velocities $\omega_1$, $\omega_2$) that will drive a sheet to its target position at the end of registration. For this aspect of the disclosed technologies, a planar model of the sheet equations of motion are established using the sheet as the frame of reference (as shown in FIG. 3) as follows:

$$\dot{x}_t=\frac{v_1+v_2}{2}\cos(\theta_t)=v\cos(\theta_t); \quad (3a)$$

$$\dot{y}_t=\frac{v_1+v_2}{2}\sin(\theta_t)=v\sin(\theta_t); \quad (3b)$$

$$\dot{\theta}_t=\frac{v_1-v_2}{2d}=\omega; \quad (3c)$$

where equations 3a-3c represent the sheet linear and angular velocities relative to the sheet axis. Thus, $x_t$ and $y_t$ denote coordinates relative to the sheet center $P_S$, and $\theta_t$ is the heading angle in the $(x_t,y_t)$ plane. The sheet speed in the process direction v and angular turn rate $\omega$ are assumed to be the control inputs.

While the above equations of motion (2a-2c), (3a-3c) use different frames of reference, a correlation of these equations can be made. The following correlation equations provide a one to one mapping between the kinematic model from the perspective of the registration system (2a-2c) and the planar model using a sheet-based perspective (3a-3c):

$$x_t=x\cos(\theta)+y\sin(\theta) \quad (4a);$$

$$y_t=x\sin(\theta)-y\cos(\theta) \quad (4b);$$

$$\theta_t=\theta \quad (4c).$$

Thus far, equations of motion have been described relative to the registration system and the sheet, respectively. However, the decoupling matrix of the input-state feedback linearization for the kinematic model (3a-3c) remains singular. In other words, a solution cannot be readily obtained from the general equations of motion above, due to the nonlinear characteristic of that model.

Thus, in accordance with an aspect of the disclosed technologies herein, the principles of dynamic extension are applied to the equations of motion. Dynamic extension can be used to change the relative degree of a system. By changing the order of an input, such as by taking derivatives or integrals of the input, you can add inputs or states to the system as required. In this way, the sheet speed is considered as a new state variable, so that the values of the system states corresponding to a sheet at a given time are redefined as:

$$\begin{bmatrix}\xi_1\\ \xi_2\\ \xi_3\\ \xi_4\end{bmatrix}=\begin{bmatrix}x_t\\ y_t\\ \theta_t\\ v_t\end{bmatrix}. \quad (5a)$$

Such system states can be measured by a sheet observer, which would yield observed state values that correspond to the system states in 5a. Additionally, acceleration is considered as a new control input variable, so that the control input values for a sheet are redefined as:

$$\eta = \begin{bmatrix} \eta_1 \\ \eta_2 \end{bmatrix} = \begin{bmatrix} a \\ \omega \end{bmatrix}; \tag{5b}$$

where a is the linear acceleration ($a=\dot{v}$) of the sheet along the sheet trajectory and ω is the angular nip velocity driving the sheet. The value of such control input variables a, ω are generally used to correct registration errors in a sheet handled by the registration system through the use of the drive nips. By generating appropriate drive wheel velocities those values a, ω are substantially imparted (input) to the sheet for controlling registration. In this way the sheet can be steered to acquire or maintain desired state values.

Now the planar model equations of motions in (3a-3c) can be rewritten as a non-linear extended sheet state vector, with the state variables from (5a) and both input variables from (5b), shown as:

$$\dot{\xi} = f(\xi) + g(\xi)\eta; \tag{6}$$

where $$f(\xi) = \begin{bmatrix} \xi_4\cos(\xi_3) \\ \xi_4\sin(\xi_3) \\ 0 \\ 0 \end{bmatrix}; \tag{7a}$$

and $$g(\xi) = \begin{bmatrix} 0 & 0 \\ 0 & 0 \\ 0 & 1 \\ 1 & 0 \end{bmatrix}. \tag{7b}$$

Next, the non-linear equation (6) can be made linear by applying the principles of input-state linearization from applied mathematics. These principles involve coming up with a transformation of the nonlinear system into an equivalent linear system through a change of variables and a suitable control input. Thus, a linearizing state variable can be used as a change of variable. For example, $z=T(\xi)$ is a linearizing state variable, which is defined as:

$$\begin{bmatrix} z_1 \\ z_2 \\ z_3 \\ z_4 \end{bmatrix} = \begin{bmatrix} \xi_1 \\ \xi_2 \\ \xi_4\cos(\xi_3) \\ \xi_4\sin(\xi_3) \end{bmatrix}, \tag{8a}$$

which represent transformed observed state values for the sheet. Also, a linearizing input variable can be used as a change of variable. For example, $\eta=M(\xi)u$ is a linearizing input variable, which is defined as:

$$M = \begin{bmatrix} \cos(\xi_3) & \sin(\xi_3) \\ -\dfrac{\sin(\xi_3)}{\xi_4} & \dfrac{\cos(\xi_3)}{\xi_4} \end{bmatrix}. \tag{8b}$$

where u represents the transformed control input values and is a new linearized sheet control parameter defined as $u=M^{-1}(\xi)\eta$.

It can be assumed that the input variable $\xi_4$ represents a linear velocity that is non-zero. Also, through the application of the linearizing state and control input variables (8a-8b), the non-linear extended sheet state vector (6) can be further transformed by taking a derivative with respect to time of the transformed observed state values. Thus, the sheet state vector (6) is transformed into a linear time invariant model (the equations are now linear and there is no time variant) as follows:

$$\dot{z} = \frac{\partial T}{\partial \xi}\dot{\xi}, \text{ or} \tag{9}$$

$$\dot{z} = \begin{bmatrix} 0 & 0 & 1 & 0 \\ 0 & 0 & 0 & 1 \\ 0 & 0 & 0 & 0 \\ 0 & 0 & 0 & 0 \end{bmatrix} z + \begin{bmatrix} 0 & 0 \\ 0 & 0 \\ 1 & 0 \\ 0 & 1 \end{bmatrix} u = Ez + Fu.$$

In accordance with an aspect of the disclosed technologies, equation (9) provides an exact linearization of the non-linear planar model described above (3a-3c), with the object of steering the sheet toward the reference trajectory (1a-1c). The reference trajectory (1a-1c) should be transformed into the linearized model domain z, as shown above. In this way, the following desired trajectory for a sheet is provided:

$$z_d = \begin{bmatrix} z_{1,d} \\ z_{2,d} \\ z_{3,d} \\ z_{4,d} \end{bmatrix} = \begin{bmatrix} \alpha t^2 + \beta t + \gamma \\ -y_d \\ v_d \\ 0 \end{bmatrix}, \tag{10}$$

which defines reference state values for the sheet.

Now having reduced the problem to a linear function of the transformed observed state values and transformed reference state values, a state feedback control can be designed to drive the errors to zero. The errors are seen by defining an error vector e, which represents the difference between the observed state values and the reference state values for the sheet. In this way, error vector e is defined as:

$$e=z-z_d \tag{11}.$$

Again, using the linear time invariant model, an error system $\dot{e}$ can be written as follows:

$$\dot{e} = \begin{bmatrix} 0 & 0 & 1 & 0 \\ 0 & 0 & 0 & 1 \\ 0 & 0 & 0 & 0 \\ 0 & 0 & 0 & 0 \end{bmatrix} e + \begin{bmatrix} 0 & 0 \\ 0 & 0 \\ 1 & 0 \\ 0 & 1 \end{bmatrix} \left( \begin{bmatrix} u_1 \\ u_2 \end{bmatrix} - \begin{bmatrix} a_d \\ 0 \end{bmatrix} \right). \tag{12}$$

Where $a_d$ is a linearization constant representing a desired linearized control parameter, such as acceleration. Also, the linearized parameters $u_1$, $u_2$ are the transformed control input values used for feedback control.

Thus, in accordance with aspects of the disclosed technologies, the error vector is stabilized providing control of the sheet position and thus the differential drive registration system to track the reference sheet trajectory and substantially drive the sheet to a registered state. By using standard stabilizing control systems techniques, such as pole placement, a 2×4 matrix defines a set of control parameters K. Such, standard stabilizing control systems techniques are disclosed for example in "Modern Control Systems," by Dorf and Bishop, $8^{th}$ Ed., Addison Wesley Longman, Inc., Menlo Park, Calif., 1998, pertinent portions which are hereby incorporated by reference. In fact, contemporary controllers include programmed processor applications using pole placement in order to obtain sets of control parameters K. The set of control parameters K determine the response of the system and are used to determine control input values for the system. In a registration system, such control parameters K are provided by the registration controller 250, which can be a stabilizing linear controller. Thus, a linearized state feedback control parameter $\bar{u}$ can be expressed as $\bar{u}=-Ke$, in order to solve for the linearized control input values $u_1$, $u_2$, as follows:

$$\begin{bmatrix} u_1 \\ u_2 \end{bmatrix} = \begin{bmatrix} a_d \\ 0 \end{bmatrix} + \bar{u}. \tag{13}$$

Given a linearized system and a desired system response, a programmed processor can generate matrix K such that a closed-loop system using $\bar{u}=-Ke$ will provide the desired response. The relationship between the linearizing input variable $\eta$ and linearized control input values u1, u2, are then used to determine the control input values for steering the sheet to a desired registration state.

Alternatively, having established linear differential equations determining the control input values, the registration controller 250 can be a linear quadratic regulator. In this way, the set of control parameters K, entered by an operator, engineer or predetermined for the system, act as weighting factors to determine, in part, the control input values by minimizing a cost function. The cost function is defined as a sum of the deviations of key measurements from their desired values. In effect this method finds those controller settings that minimize the undesired deviations, like deviations from the desired trajectory. The magnitude of the control action itself can be included in the control parameters to limit energy expenditure or forces imparted on a sheet. The linear quadratic regulator takes care of the tedious work done of optimizing the controller. Generally, the weighting factors must still be specified and the results compared with specified design goals.

In this way, a registration controller 250 utilizing the above applications of dynamic extension, input-state linearization and state feedback can generate sheet control input values. Such sheet control input values direct the servo-controls 260, 270 to actuate the nip assemblies and thereby generate drive wheel velocities that drive each sheet to desired positions along the reference trajectory. The sheet sensors 210 are used to measure and/or calculate the initial position $x_0$, $y_0$ and orientation $\theta_0$ of the sheet. Those initial values $x_0$, $y_0$, $\theta_0$ are used by a reference generator 230 that generates reference values $x_{ref}$, $y_{ref}$, $\theta_{ref}$ used by the registration controller 250, and described in (1a-1c). Also, the nip encoders 220 measure velocity readings, for example from the idler rollers 104, representing sheet velocities $v_1$, $v_2$ at the contact points. Those contact point sheet velocities $v_1$, $v_2$ are used by the sheet observer 240, in combination with the initial position $x_0$, $y_0$ and orientation $\theta_0$ measurements to generate estimates of the sheet position and orientation (also referred to herein as observed sheet position $x_{Obs}$, $y_{Obs}$ and an observed sheet orientation $\theta_{Obs}$). The observed values $x_{Obs}$, $y_{Obs}$, $\theta_{Obs}$ are also used by the registration controller 250, in combination with the reference values $x_{ref}$, $y_{ref}$, $\theta_{ref}$ to calculate an error vector. The controller uses the above information to generate nip reference velocity values $v_{1,ref}$, $v_{2,ref}$. The servo-controls 260, 270 can then change the current nip velocity $v_1$, $v_2$ to the reference velocity values by adjusting the voltages and/or currents $c_1$, $c_2$ that drive each motor. In this way, the controller 250 can continually use position feedback as a closed-loop process to maintain the sheet on the reference trajectory.

Due to the limited amount of time available to perform registration, employing gain-scheduling or a variable set of gains within the controller 250 may be a advantageous component in a sheet registration system employing closed-loop feedback control. Gain scheduling may be used, for example, by sheet registration systems in the presence of otherwise insurmountable constraints with, for example, a static set of gains. A gain schedule effectively minimizes the forces placed on a sheet while still achieving sheet registration. The controller 250 may perform this by, for example, starting with low gains to minimize the high accelerations characteristic of the early portion of registration and then increasing the gain values as the sheet progresses through the sheet registration system to guarantee convergence in the available time.

If no system constraints existed, the gain parameters could suffice to determine the control of the sheet. However, the time period for sheet registration is limited based on the throughput of the device. In addition, violating maximum tail wag and/or nip force requirements may create image quality defects. Tail wag and nip force refer to effects which may damage or degrade registration of the sheet. For example, excessive tail wag could cause a sheet to strike the side of the paper path. Likewise, if a tangential nip force used to accelerate the sheet exceeds the force of static friction, slipping between the sheet and drive roll will occur. To satisfy the time constraints for a sheet registration system, high gain values and a small value of b (see FIG. 3) may be desirable. However, to limit the effects of tail wag and nip force below acceptable thresholds, gain parameters may be adjusted accordingly. Depending on the input error and machine specifications, a viable solution may not exist if the gain values are static. In order to circumvent these constraints, gain scheduling may be employed to permit adjustment of the gain values during the sheet registration process. Relatively low gain values may be employed at the onset of the registration process in order to satisfy max nip force and tail wag constraints, and relatively higher gain values may be employed towards the end of the process to guarantee timely convergence. The gain values may be adjusted to avoid a consistent amount of damping. Also, optimization of controller gains and control parameters can potentially result in faster convergence to a desired trajectory and better registration.

In accordance with further aspects of the disclosed technologies herein, the registration controller 250 can work with or be combined with other forms of registration actuators, sensors and control parameter optimization methods to deliver high performance results.

Often media handling assembly, and particularly printing systems, include more than one module or station. Accordingly, more than one registration apparatus as disclosed herein can be included in an overall media handling assembly. Further, it should be understood that in a modular system or a system that includes more than one registration apparatus, in accordance with the disclosed technologies herein, could detect sheet position or other sheet characteristics and relay that information to a central processor for controlling registration, including errors in process, lateral or skew positioning within the overall media handling assembly. Thus, if the registration error is too large for one registration system to correct, then correction can be achieved with the use one or more subsequent downstream registration systems, for example in another module or station.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. A method of registering sheets moved along a transport path in a differential drive registration system of a media handling assembly, the method comprising:

identifying observed state values corresponding to a sheet handled by the differential drive registration system, determining an error vector, wherein the error vector is defined by a difference between the observed state values and reference state values for the sheet, wherein control input values are determined based on the error vector, a set of control parameters, and the observed state values, the control input values being determined such that there is a linear differential relationship between the observed state values and the control input values; and generating drive wheel velocities in the differential drive registration system based on the control input values, wherein the identifying and determining steps being repeated for the sheet in a closed-loop process such that the observed state values substantially track the reference state values, wherein the control input values are determined by a stabilizing linear controller that stabilizes the error vector.

2. The method of claim 1, wherein the control input values are determined such that derivatives with respect to time of transformed observed state values are a linear function of the transformed observed state values and transformed control input values.

3. The method of claim 1, wherein the error vector is determined at least partially by converting observed state values into linearized state values.

4. The method of claim 1, wherein at least one set of observed sheet state values are measured directly by a sensor.

5. The method of claim 1, wherein the observed state values include at least one of the speed, position and orientation of the sheet relative to the differential drive registration system.

6. The method of claim 1, wherein the determination of the error vector is based on a linearized sheet trajectory that corresponds to the reference state values.

7. The method of claim 1, wherein the control input values include a linear acceleration and an angular velocity.

8. The method of claim 1, wherein the control input values define a linear time invariant system.

9. The method of claim 1, wherein the determination of the error vector is based at least in part on a non-linear transformation to basic equations of motion for the sheet, thereby introducing a change of state variable, wherein the change of state variable represents the sheet speed and is not zero.

10. A method of registering sheets moved along a transport path in a differential drive registration system of a media handling assembly, the method comprising:

determining an error vector for a sheet, wherein the error vector is defined by a difference between observed state values and reference state values, and generating control input values based on the error vector, a set of control parameters, and the observed state values, the control input values being determined such that there is a linear differential relationship between the observed state values and the control input values, whereby using a closed-loop feedback control system the control input values determine drive wheel velocities in the differential drive registration system that substantially drive the sheet to a registered sheet state, wherein the sheet input control values are generated by a stabilizing linear controller that stabilizes the error vector.

11. The method of claim 10, wherein the control input values are determined such that derivatives with respect to time of transformed observed state values are a linear function of the transformed observed state values and transformed control input values.

12. The method of claim 10, wherein the error vector is determined at least partially by converting observed state values into linearized state values.

13. The method of claim 10, wherein at least one set of observed sheet state values are measured directly by a sensor.

14. The method of claim 10, wherein each set of sheet state values includes at least one of the speed, position and orientation of the sheet relative to the differential drive registration system.

15. The method of claim 10, wherein the determined drive wheel velocities are generated by changing a voltage to at least one motor that operates a drive wheel directly engaging the sheet.

16. The method of claim 10, wherein the control input values include a linear acceleration and an angular velocity for the drive wheels.

17. The method of claim 10, wherein the control input values define a linear time invariant system.

18. The method of claim 10, wherein the determination of the error vector is based at least in part on a non-linear transformation to basic equations of motion for the sheet.

* * * * *